United States Patent [19]

Tomita

[11] Patent Number: 4,632,475

[45] Date of Patent: Dec. 30, 1986

[54] HINGED ELECTRICAL CONNECTOR

[75] Inventor: Akira Tomita, Yamato, Japan

[73] Assignee: AMP Incorporated, Harrisburg, Pa.

[21] Appl. No.: 861,657

[22] Filed: May 5, 1986

Related U.S. Application Data

[63] Continuation of Ser. No. 665,325, Oct. 26, 1980, abandoned.

[30] Foreign Application Priority Data

Nov. 11, 1983 [JP] Japan ..... 58-211085

[51] Int. Cl.[4] ..... H01R 9/09

[52] U.S. Cl. ..... 339/4; 339/176 MP

[58] Field of Search ..... 339/4, 74 R, 75 MP, 339/176 MP

[56] References Cited

U.S. PATENT DOCUMENTS 2,740,097 3/1956 Edelman et al. ..... 339/4

3,601,746 8/1971 Teagno ..... 339/4

FOREIGN PATENT DOCUMENTS 52-41089 9/1977 Japan .

57-127491 8/1982 Japan .

60-79681 5/1985 Japan .

1004011 9/1965 United Kingdom .

*Primary Examiner*—Joseph H. McGlynn

*Attorney, Agent, or Firm*—Bruce J. Wolstoncroft; Adrian J. LaRue

[57] ABSTRACT

An electrical connector comprises first and second dielectric housings each having cavities in which male and female electrical contacts are respectively secured, the male electrical contacts have male contact portions extending outwardly from the first housing and are disposed in respective female contact portions of the female electrical contacts, hinge sections on the first and second housings hingedly connecting the housings together so that when the male and female electrical contacts are connected to respective printed circuit boards, the boards can be moved from a position at which the boards are at right angles to a position at which the boards are substantially coplanar.

7 Claims, 16 Drawing Figures

FIG. 1A
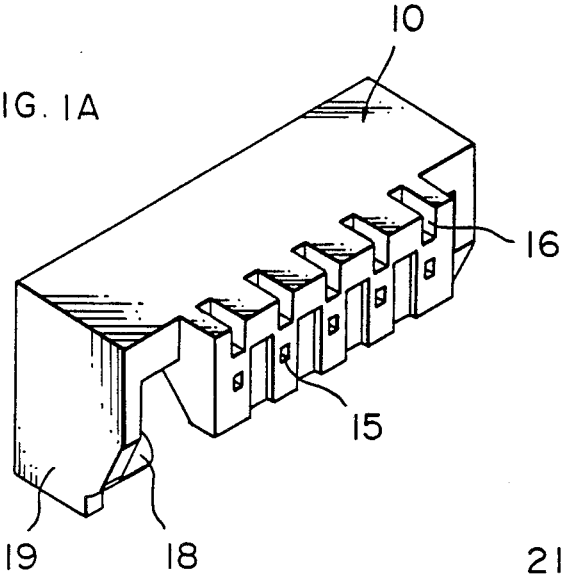
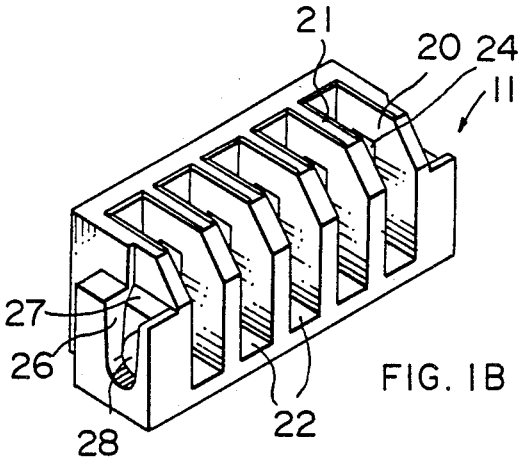
FIG. 1B

HINGED ELECTRICAL CONNECTOR

This application is a continuation of application Ser. No. 665,325 filed 10,26,1980 now abandoned.

FIELD OF THE INVENTION

The present invention relates to an electrical connector and in particular to a hinge-type electrical connector which electrically interconnects a pair of printed circuit boards and which permits one of the printed circuit boards to rotate by a predetermined angle with respect to the other printed circuit board.

BACKGROUND OF THE INVENTION

A hinged electrical connector is known in which two housings arranged opposite each other are connected to each other at the opposed surfaces thereof by a hinged so as to render the housings bendable and in which electrical contacts are accommodated in each housing, the contacts being connected electrically to each other by a bendable conductor extending between the housings.

In this connector, the connector is detachably connected to post contacts of post headers, which are respectively secured on a pair of printed circuit boards so that the printed circuit boards are electrically connected to each other through the post contacts, contacts, and bendable conductors.

The electrical connector of the above construction has the following advantages. Since it is bendable via the hinge, it permits a pair of printed circuit boards to be arranged in a coplanar manner on an assembly line so that electrical and mechanical tests or adjustments of components or devices on the printed circuit boards can be easily conducted. Also, after completion of such tests and adjustments, either of the pair of printed circuit boards can be rotated by a predetermined angle so that the printed circuit boards can be installed in a smaller area. This enables the equipment to be smaller and the manufacturing efficiency higher.

However, on the other hand, the connector having the above construction has the following disadvantages. In order to electrically connect a pair of printed circuit boards to each other, it is indispensable that each printed circuit board have a post header to which the electrical connector is connected. This not only increases the number of components or parts of the printed circuit boards but also increases the number of assembly operations so that the manufacturing cost is increased. Furthermore, contacts accommodated in the two housings are connected to each other by the bendable conductors so that the connection is indirect with the result that the wiring length is increased which affects the electrical and mechanical properties of the connector.

SUMMARY OF THE INVENTION

The present invention overcomes the above-mentioned problems. The object of the present invention is to provide a hinge-type electrical connector which is small and light and which avoids electrical and mechanical properties. Also, housings and contacts of the connector are separable, respectively, so that maintenance thereof can be easily conducted. Furthermore, a pair of printed circuit boards can be disposed in a substantially coplanar manner while maintaining an electrical connection therebetween so that electrical and mechanical adjustments and tests of electrical components or devices on the printed circuit boards on an assembly line can be easily and readily conducted.

According to the present invention, an electrical connector comprises first and second dielectric housings each having cavities in which male and female electrical contacts are respectively secured, the male electrical contacts have male contact portions extending outwardly from the first housing and are disposed in respective female contact portions of the female electrical contacts, hinge sections on the first and second housings hingedly connecting the housings together so that when the male and female electrical contacts are connected to respective printed circuit boards, the boards can be moved from a position at which the boards are at right angles to a position at which the boards are substantially coplanar.

BRIEF DESCRIPTION OF THE DRAWINGS

FIGS. 1A and 1B are perspective view of male and female housings that form the hinged connector according to the present invention.

DETAILED DESCRIPTION OF THE INVENTION

FIG. 1A shows a male housing 10 and FIG. 1B shows a female housing 11. Male and female housing 10, 11 accommodate a plurality of male contacts 12 and female contacts 13, respectively, as shown in FIG. 2, and male housing 10 having male contacts 12 is rotatably connected to female housing 11 including female contacts 13 as shown in FIGS. 5, 7 and 8.

Housings 10, 11 are molded from suitable dielectric material having desirable dielectric and flexible characteristics and contacts 12, 13 are stamped and formed from suitable metal having desirable electrical and spring characteristics.

Figure 2:
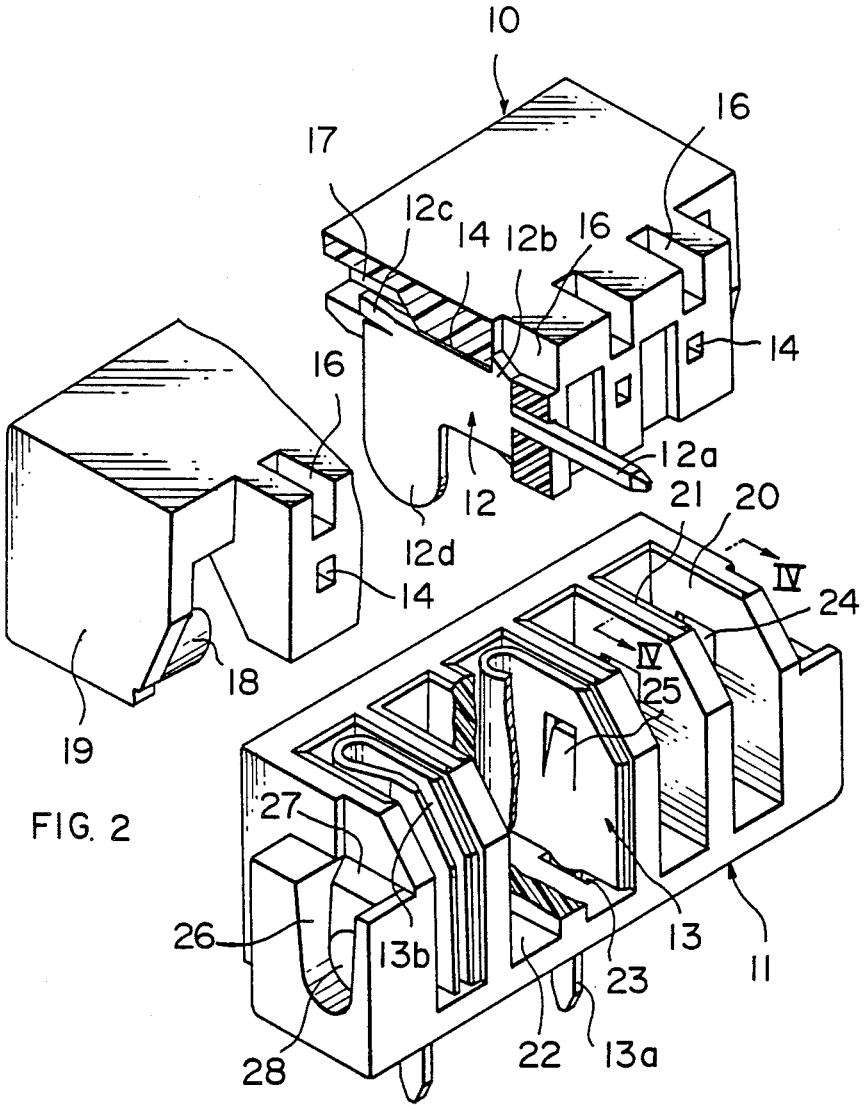
FIG. 2 is a part cutaway perspective view of the male and female housings having male contacts and female contacts respectively therein.
Figure 3A:
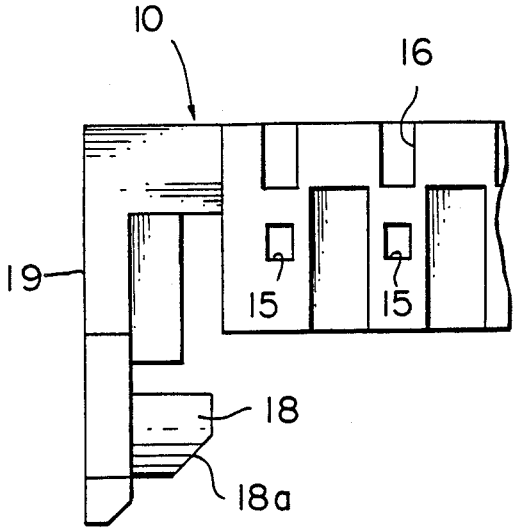
FIG. 3A is a fragmentary front elevational view of the male housing used in the invention.
Figure 3B:
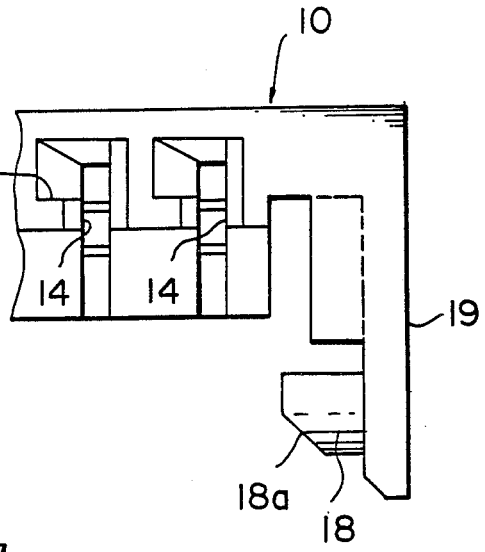
FIG. 3B is a rear elevational view thereof.

Male housing 10, as shown in FIGS. 1 to 3, has a plurality of cavities 14 which are equidistantly spaced in a longitudinal direction of housing 10. Each cavity 14 is provided at the end portion thereof with a square aperture through which post portion **12*a* of male contact 12 extends. Notched portions 16 respectively communicate with each cavity 14 and stepped portions 17 are formed in each cavity 14 and are engaged by first projection 12*b* and the second projection 12*c* on male contact 12 so that male contact 12 is retained in cavity 14**.

Male housing 10 has at opposite ends flexible arms 19, each arm 19 having a projection 18 which engages with female housing 11. An inclined surface 18*a* (FIG. 3) is located on each projection 18 so that projection 18 engages easily with female housing 11 as explained hereafter.

Figure 4:
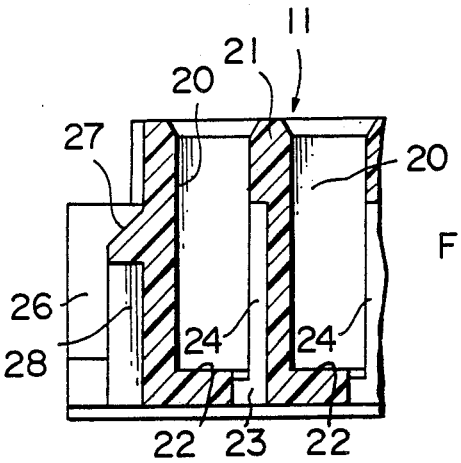
FIG. 4 is a cross-sectional view taken along the line IV—IV of FIG. 2.
Figure 5A:
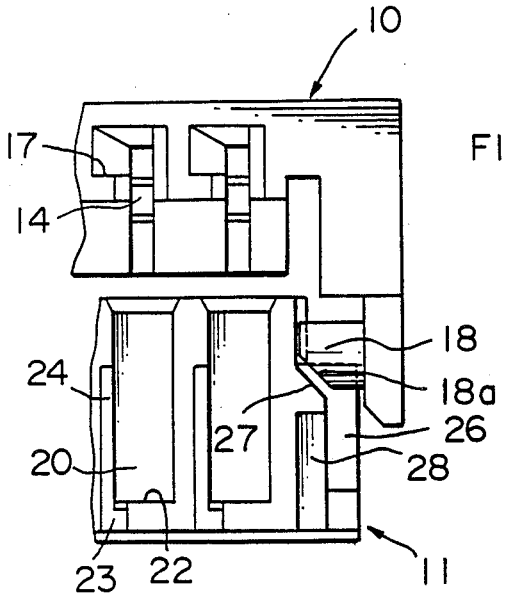
FIGS. 5A, 5B and 5C are fragmentary views showing the assembly of a hinge portion which hingedly connects the male housing and the female housing together.
Figure 5B:
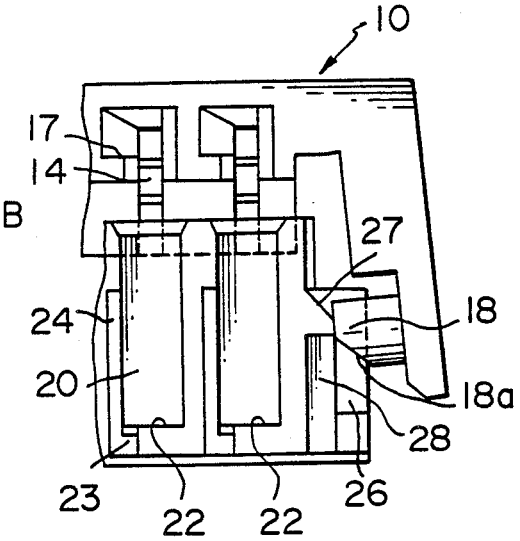
Figure 5C:
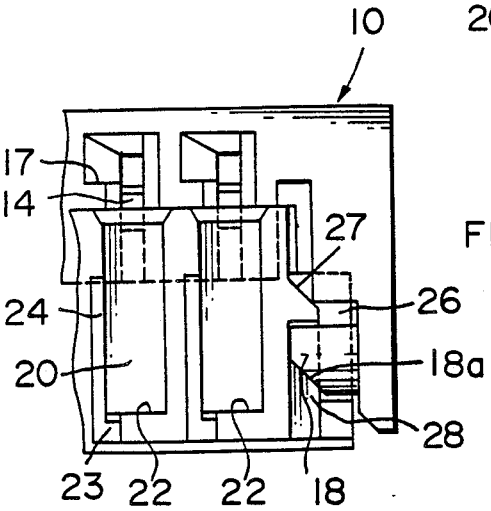

Female housing 11 accommodating female contacts 13 has a plurality of cavities 20 which are equidistantly spaced in a longitudinal direction of the housing as shown in FIG. 2. Cavities 20 correspond to cavities 14 of male housing 10. Each cavity 20 is formed by separating walls 21, each wall 21 having on an inner surface a recess 24 (FIG. 4) which communicates with an aperture 23 extending through a bottom 22 of cavity 20. Post portion 13*a* of female contact 13 is inserted into aperture 23, and a lance 25 on receptacle portion 13*b* engages with recess 24 so that female contact 13 is retained in cavity 20. Female housing 11 has at opposite ends open U-shaped recesses 26 which receive projections 18 of male housing 10, thereby forming a hinge therebetween as shown in FIG. 5C.

Each recess 26 includes an inner surface which has an inclined surface 27 and a hole 28 which receives a respective projection 18 therein. As shown in FIGS. 5A to 5C, inclined surfaces 18*a* of projections 18 of male housing 10 slide downward along inclined surfaces 27 of recesses 26 of female housing 11 and the inner surfaces of projections 18 then slide along the inner surfaces of recesses 26 which causes arms 19 of male housing 10 to resiliently bend outward and then projections 18 are snap-fitted into respective holes 28. Projections 18 are reciprocally movable in holes 28 and this arrangement forms a hinge for both housings 10, 11.

Figure 6A:
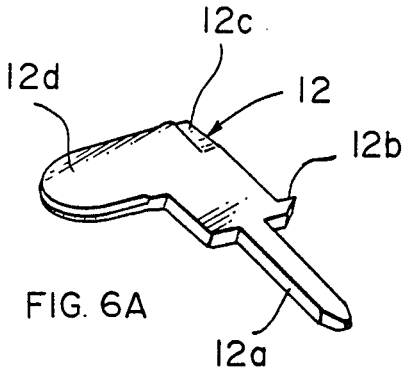
FIGS. 6A and 6B show perspective views of the male and female contacts respectively.

Male contact 12 includes, as shown in FIG. 6A, post portion 12*a*, to be inserted into a hole of a printed circuit board 33 as shown in FIGS. 7 and 8, first projection 12*b* which is disposed in notched portion 16 of male housing 10, second projection 12*c* which engages with stepped portion 17 of male housing 10. Projection tongues 12*d* of contacts 12 are inserted into respective receptacle portions 13*b* of female contacts 13 when housings 10, 11 are hingedly connected together as shown in FIGS. 7 and 8.

Figure 6B:
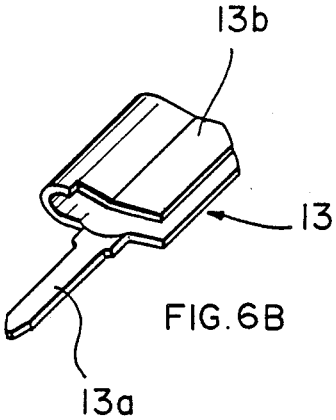

Female contact 13 includes, as shown in FIG. 6B, post portion 13*a* to be inserted into a hole of printed circuit board 34, as shown in FIGS. 7 and 8, in the same manner as post portion 12*a* of male contact 12, and a receptacle portion 13*b* having a U-shaped cross section, which has a lance 25 in one leg of receptacle portion 13*b* and which receives projecting tongue 12*d* therein when housings 10, 11 are hingedly connected together as shown in FIGS. 7 and 8.

Figure 8A:
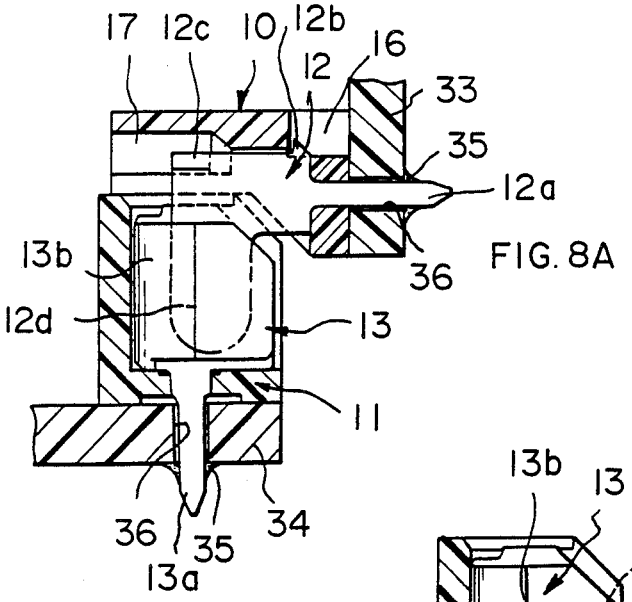
FIGS. 8A and 8B are cross-sectional views of FIGS. 7A and 7C.
Figure 8B:
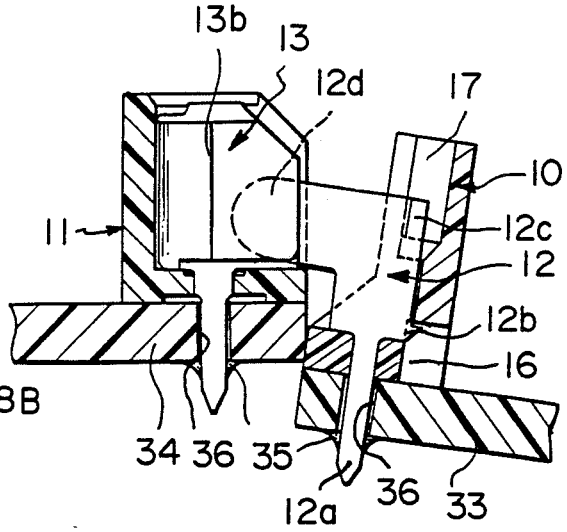
Figure 7A:
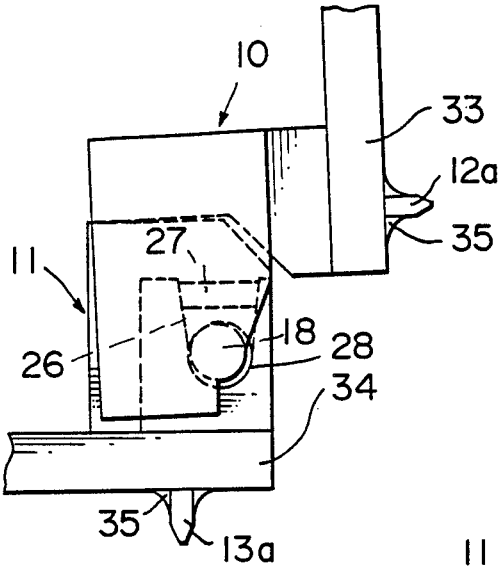
FIGS. 7A, 7B and 7C are side elevational views of the connector electrically connected to printed circuit boards and showing the angular orientation of the boards relative to one another.
Figure 7B:
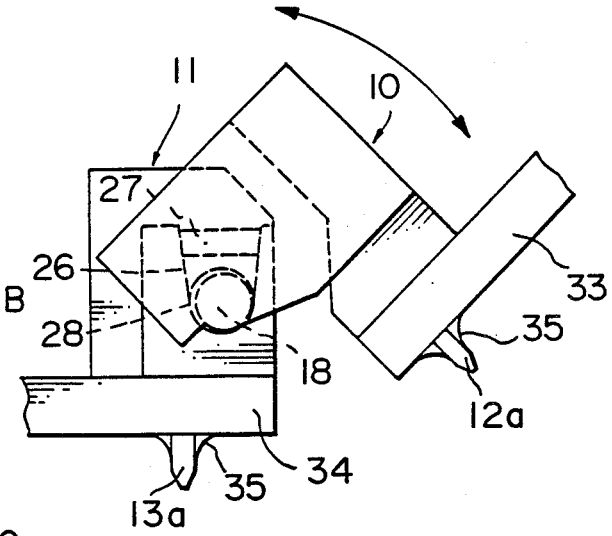
Figure 7C:
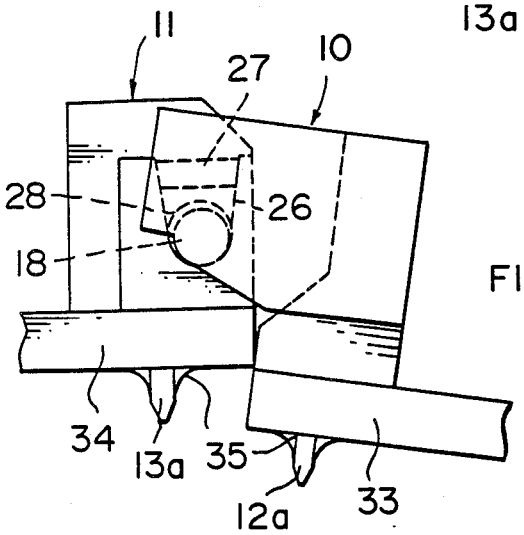

FIGS. 7A to 7C show the connectors mounted on printed circuit boards 33, 34, which are in the course of being moved from a right angle position to a position beyond being coplanar, and also, FIGS. 8A and 8B show a cross section of the connectors in positions before and after the rotation thereof. In FIGS. 8A and 8B, male and female housings 10, 11 having male contacts 12 and female contacts 13 respectively mounted therein are secured to printed circuit boards 33, 34 by use of solder 35 to solder post portions 12*a*, 13*a* of both contacts 12, 13 to respective conductive paths on boards 33, 34, post portions 12*a*, 13*a* extending through respective holes 36 of printed circuit boards 33, 34.

In order to connect connectors 10, 11 to each other, projecting tongues 12*d* of male contacts 12 in male housing 10 are inserted into respective receptacle portions 13*b* of female contacts 13 in female housing 11, and at the same time, projections 18 at the opposite ends of male housing 10 are slid along recesses 26 at the opposite ends of female housing 11 and are snap-fitted into respective holes 28 of recesses 26 so that a hinge is formed thereby hingedly connecting housings 10, 11 together.

The connector, in a normal position, takes a position in which printed circuit boards 33 and 34 are arranged at right angles to each other, as shown in FIGS. 7A and 8A, and when electrical and mechanical tests and adjustments of components or devices are to be conducted on printed circuit boards 33, 34, the connector is rotated to the position shown in FIGS. 7C and 8C via that of FIG. 7B so that printed circuit boards 33, 34 are in a substantially coplanar relationship with each other. By this arrangement, such tests and adjustments as needed can be easily and effectively conducted. As shown in FIGS. 7A and 8A, housings 10, 11 engage each other defining a stop to position boards 33, 34 at a right angle while in FIGS. 7C and 8B, housing 10 engages the edge of board 34 defining a stop.

In order to disengage housings 10, 11 from each other, flexible legs 19 carrying projections 18 are flexed outwardly and housing 10 moved upwardly.

According to the present invention, the connector uses thin and flat male and female contacts which are made from a conductive metal sheet so that the distance between the adjacent cavities accommodating the contacts can be small and thus a small connector can be utilized. Also, the male contacts are rotatable with respect to the female contacts so that a wiping action takes place at the contact surface between the contacts and thus a stable electrical connection is always provided. Furthermore, the connector can be mounted directly on the printed circuit boards without using post headers as in the conventional connector, with the result that the number of parts to be mounted on the printed circuit boards is decreased and a small and low-profile connector is realized. Also, since it is easy for hinge portions of the connector to be assembled and released, the printed circuit boards can be easily loaded on an assembly line of electrical components and easy adjustments, tests, and maintenance of electronic equipment can be conducted.

I claim:

1. An electrical connector for hingedly and electrically connecting printed circuit boards together enabling the boards to be positioned at a right angle or to be positioned substantially coplanar, comprising:

first and second dielectric housings, the first housing having first electrical contacts secured therein and the second housing having second electrical contacts secured therein, the first and the second electrical contacts having matable contact sections electrically connecting the electrical contacts together when the first and second dielectric housings are mounted to each other;

a flexible arm spaced from and parallel to each end wall of the first housing, the flexible arm having a projection with an inclined surface which extends therefrom in the direction of the end wall; and a U-shaped recess provided on each end wall of the second housing, side walls of the recess being perpendicular to a circuit board mounting surface of the second housing, the recess having an inner surface, a portion of which is inclined, and a hole within the inner surface such that as mounting of the first housing to the second housing occurs, each projection of the first housing slides along the inner surface of the respective recess of the second housing causing the arm to bend outward allowing the projection to be snap-fitted into the hole, thereby hingedly connecting the first and second housings together enabling the first and second housings to be movable relative to each other when the first and second electrical contacts are electrically connected to respective printed circuit boards thereby enabling the printed circuit boards to be positioned at a ring angle or to be positioned in a substantially coplanar position.

2. An electrical connector as set forth in claim 1, wherein said first electrical contacts have tongue sections and said second electrical contacts have U-shaped receptacle sections respectively receiving said tongue sections.

3. An electrical connector for hingedly and electrically connecting printed circuit boards together enabling the boards to be positioned at a right angle or to be positioned substantially coplanar, comprising:

first and second dielectric housings, the first housing having first electrical contacts secured therein and the second housing having second electrical contacts secured therein, the contacts being in electrical contact with each other when the first and second dielectric housings are mounted to each other;

a flexible arm spaced from and parallel to each end wall of the first housing, the flexible arm having a projection with an inclined surface which extends therefrom in the direction of the end wall; and a U-shaped recess provided on each end wall of the second housing, side walls of the recess being perpendicular to a circuit board mounting surface of the second housing, the recess having an inner surface, a portion of which is inclined, and a holw within the inner surface such that as mounting of the first housing to the second housing occurs, each projection of the first housing slides along the inner surface of the respective recess of the second housing causing the arm to bend outward, allowing the projection to be snap-fitted into the hole, thereby hingedly connecting the first housing and the second housing together enabling the first and second housings to be movable relative to each other when the electrical contacts are electrically connected to respective printed circuit boards thereby enabling the printed circuit boards to be at a right angle orientation which is reached when the first and second housings engage each other thereby defining a first stop position or to be in a substantially coplanar orientation which is reached when the printed circuit boards are disposed substantially coplanar defining a second stop position.

4. An electrical connector as set forth in claim 3, wherein said first electrical contacts have tongue sections disposed in respective U-shaped sections of said second electrical contacts.

5. An electrical connector for hingedly and electrically connecting printed circuit boards together enabling the boards to be positioned at a right angle or to be positioned substantially coplanar, comprising:

first and second dielectric housings, the first housing having first electrical contacts secured therein and the second housing having second electrical contacts secured therein, the first and the second electrical contacts having matable contacts sections electrically connecting the electrical contacts together when the first and second dielectric housings are mounted to each other;

flexible arm means provided by said first housing including inwardly directed projection means;

recess means as part of end walls of the second housing and being oriented so as to receive said projection means, said recess means including hole means in which said projection means are disposed hingedly connecting the housings together; and means provided by said projection means and said recess means causing said flexible arm means to flex outwardly as said projection means moves along said recess means until said projection means are positioned within said hole means.

6. An electrical connector as recited in claim 5, wherein the means provided by the projection means and the recess means are inclined surfaces provided on a bottom portion of the projection means and at a receiving edge of the recess means.

7. An electrical connector as recited in claim 6, wherein the recess means is a U-shaped recess.

* * * * *

UNITED STATES PATENT OFFICE
CERTIFICATE OF CORRECTION

Patent No. 4,632,475 Dated December 30, 1986

Inventor(s) Akira Tomita

It is certified that error appears in the above-identified patent and that said Letters Patent are hereby corrected as shown below:

It is certified that errors appear in the above-identified patent and that said Letters Patent are hereby corrected as shown below:

Claim 1, column 5, line 12, change "ring" to ---right---;

Claim 3, column 5, line 38, change "holw" to ---hole---; and

Claim 5, column 6, line 23, change matable "contacts" to matable ---contact---.

Signed and Sealed this

Tenth Day of March, 1987

*Attest:*

DONALD J. QUIGG

*Attesting Officer*

*Commissioner of Patents and Trademarks*